US007607393B2

(12) United States Patent
Menefee

(10) Patent No.: US 7,607,393 B2
(45) Date of Patent: Oct. 27, 2009

(54) SLUG BALL AMMUNITION

(75) Inventor: James Y. Menefee, Macon, GA (US)

(73) Assignee: Alliant Techsystems Inc., Edina, MN (US)

( * ) Notice: Subject to any disclaimer, the term of this patent is extended or adjusted under 35 U.S.C. 154(b) by 995 days.

(21) Appl. No.: 10/915,210

(22) Filed: Aug. 10, 2004

(65) Prior Publication Data

US 2006/0032392 A1 Feb. 16, 2006

(51) Int. Cl.
*F42B 8/12* (2006.01)

(52) U.S. Cl. ..... 102/502; 102/460; 102/462

(58) Field of Classification Search ..... 102/456, 102/460, 462, 502

See application file for complete search history.

(56) References Cited

U.S. PATENT DOCUMENTS

| | | | | | |
|---|---|---|---|---|---|
| 4,479,438 | A | * | 10/1984 | Bilsbury | 102/454 |
| 4,538,520 | A | | 9/1985 | Schmitz | 102/439 |
| 4,676,169 | A | | 6/1987 | Maki | 102/439 |
| 4,779,535 | A | | 10/1988 | Maki | 102/501 |
| 5,016,538 | A | | 5/1991 | Sowash | 102/520 |
| 5,175,389 | A | | 12/1992 | Kramer et al. | 102/521 |
| 5,214,238 | A | | 5/1993 | Young | 102/520 |
| 5,235,915 | A | | 8/1993 | Stevens | 102/439 |
| 5,361,700 | A | * | 11/1994 | Carbone | 102/439 |
| 5,408,931 | A | | 4/1995 | Tallman | 102/439 |
| 5,479,861 | A | | 1/1996 | Kinchin | 102/439 |
| 5,623,118 | A | | 4/1997 | Jackson | 102/451 |
| 5,837,927 | A | | 11/1998 | Buenemann, Jr. | 102/532 |
| 5,861,572 | A | | 1/1999 | Schuermann | 102/449 |
| 5,970,878 | A | | 10/1999 | Gardner | 102/449 |
| 5,979,330 | A | | 11/1999 | Cornell | 102/451 |
| 6,067,909 | A | | 5/2000 | Knoster, Jr. | 102/517 |
| 6,164,209 | A | | 12/2000 | Best et al. | 102/450 |
| 6,230,630 | B1 | * | 5/2001 | Gibson et al. | 102/513 |
| 6,260,484 | B1 | | 7/2001 | Billings | 102/453 |
| 6,367,389 | B1 | | 4/2002 | Westrom | 102/439 |
| 6,415,719 | B1 | * | 7/2002 | Buccelli et al. | 102/457 |
| 6,502,516 | B1 | | 1/2003 | Kinchin | 102/517 |
| 6,539,873 | B2 | | 4/2003 | Diller | 102/458 |
| 2001/0027619 | A1 | | 10/2001 | Randall et al. | 42/76.01 |
| 2001/0042486 | A1 | | 11/2001 | Dales et al. | 102/449 |

* cited by examiner

*Primary Examiner*—Stephen M Johnson
(74) *Attorney, Agent, or Firm*—Vidas, Arrett & Steinkraus PA

(57) ABSTRACT

A shotshell of the type including a slug projectile includes a wad modified to include a central depression against which a light-weight ball is centered between the wad and the slug. The slug may include a similar depression such that the momentary connection between the wad, ball and slug may increase accuracy of the ammunition.

6 Claims, 4 Drawing Sheets

22
12
48
52
46
24
40
14
36
10
38
34
32
26
30
28
16
20
18

SLUG BALL AMMUNITION

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to ammunition, in particular shotgun shells having slugs rather than a plurality of pellets.

Shotgun slugs usually refer to shotgun shells which fire a single slug of metal instead of a plurality of pellets. Such shells are designed for use against larger targets, such as deer. Unfortunately, while the relatively large diameter and overall weight of shotgun slugs are very lethal, they tend to be less accurate than desired due to unrifled barrels and other design constraints in shotguns.

Prior art approaches vary, and include using rifled barrels and slugs that can take advantage of such barrels (quite limited, since most shotguns are not rifled) and the use of sabots (which are plastic sleeves that hold the slug during firing).

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides a shotgun shell of the type having a slug (such as for deer hunting) rather than individual shot. The wad is modified slightly such that its upper end has a depression into which part of a plastic ball may sit. The slug has a concave back end such that the slug sits on the plastic ball. As the ignited propellant expands the wad compresses and keeps gases from escaping. The wad is pushed out, with the ball keeping the slug centered in the shotshell until it exits, ideally improving the accuracy of the slug.

The invention uses a sphere (ball) of preferably inexpensive, lightweight, relatively hard plastic, such as polypropylene, to serve as a centering device in a shotshell or other cartridge. This ball keeps the hollow based "slug" in alignment with the bore of the gun, by linking it positively, during acceleration, to the wadding—but then, upon leaving the barrel, allowing a clean release from the wadding, allowing the projectile to go to the target without disruption of any drag, etc. caused by wadding.

Some of the advantages of the invention include:

1) Increased accuracy of "Foster Type" lead slugs (old problem addressed).

2) Higher speeds attainable—or lower speeds with much more accuracy, (Low Recoil, Law Enforcement)

3) Allows hard, non-toxic, sub-bore diameter slugs to be used by having no bore contact (new problem addressed).

4) Control of shapes, sizes, weight distribution of such slugs is possible using this technology. Drag coefficients can be greatly improved. Full bore diameter slugs made of either pure, soft lead, or harder alloys can be used with this system, and maintain accuracy.

Using a ball with foster slugs and a wad which has an appropriately sized depression or "dimple" does the following:

1) Locates the projectile in the exact center of the wad, and by extension, the barrel.
2) Limits distortion of the wad by creating much more surface area of the projectile to bear on the wad.
3) Prevents wad parts from getting up into the cavity and possibly hanging on during flight.
4) Insures clean and total separation from the wad at the moment deceleration starts.
5) In soft lead slugs, allows more of a "designer" approach to shape and weight distribution. For example, permits very thin sidewall "skirt" to be used because the ball takes up much of the stress of firing. Allows more of the total weight of the slug in the nose.
6) In hard steel/iron, tungsten or other metal slugs, you can make them sub-bore diameter and they will not touch the gun barrel, so you don't need protective wad petal or sabot type wads.

BRIEF DESCRIPTION OF THE DRAWINGS

A detailed description of the invention is hereafter described with specific reference being made to the drawings in which.

DETAILED DESCRIPTION OF THE INVENTION

Figure 1:
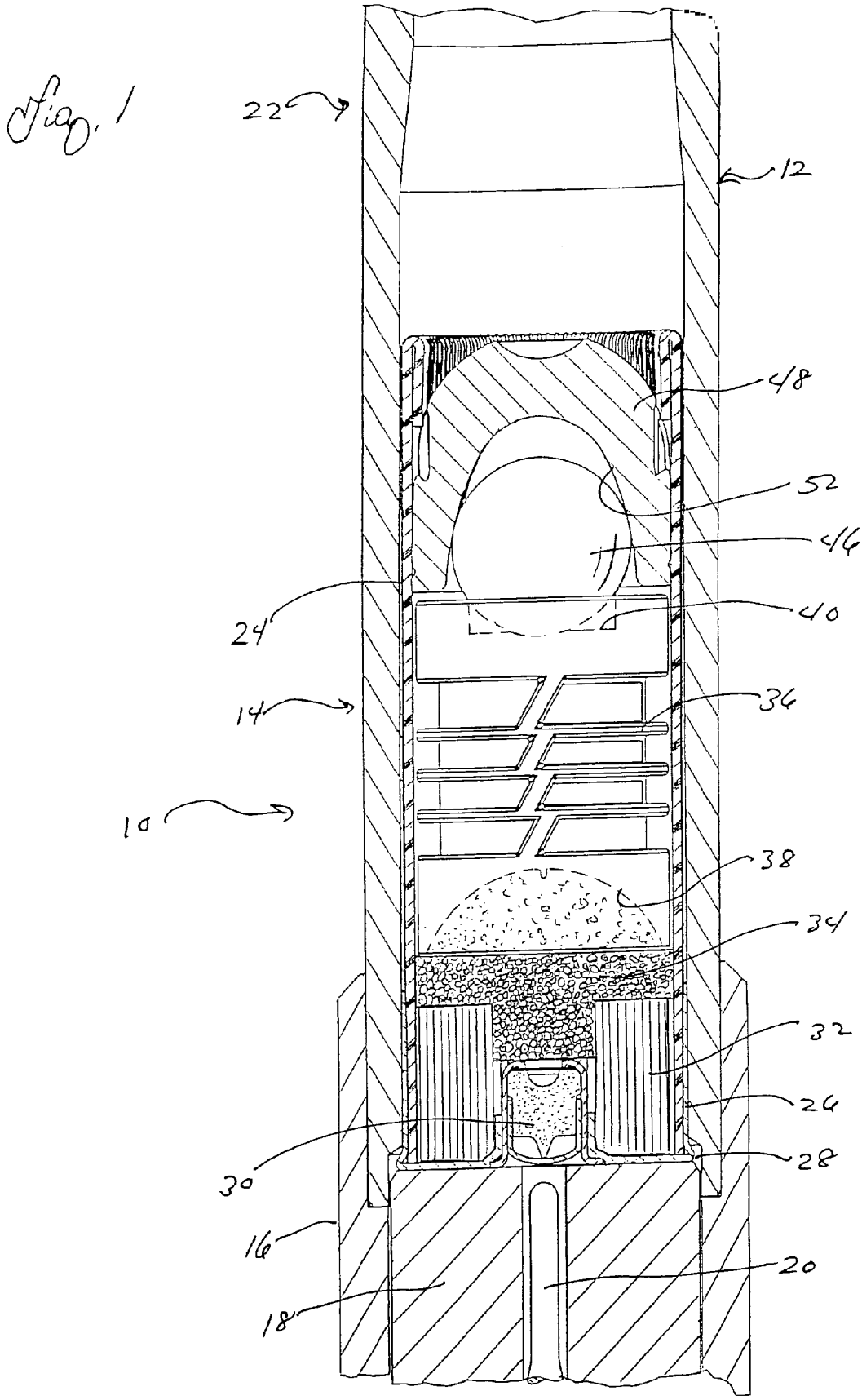
FIG. 1 is a side view of a shotshell of the invention in a shotgun in cross-section.

The inventive shotgun shell 10 of the invention as shown in FIG. 1 is depicted within a shotgun barrel 12, situated in the chamber 14, showing the relationship of the receiver 16 to the bolt 18 and firing pin 20 of the shotgun. The forcing cone 22 portion of the barrel 12 is shown immediately after the shotgun shell 10.

Figure 3:
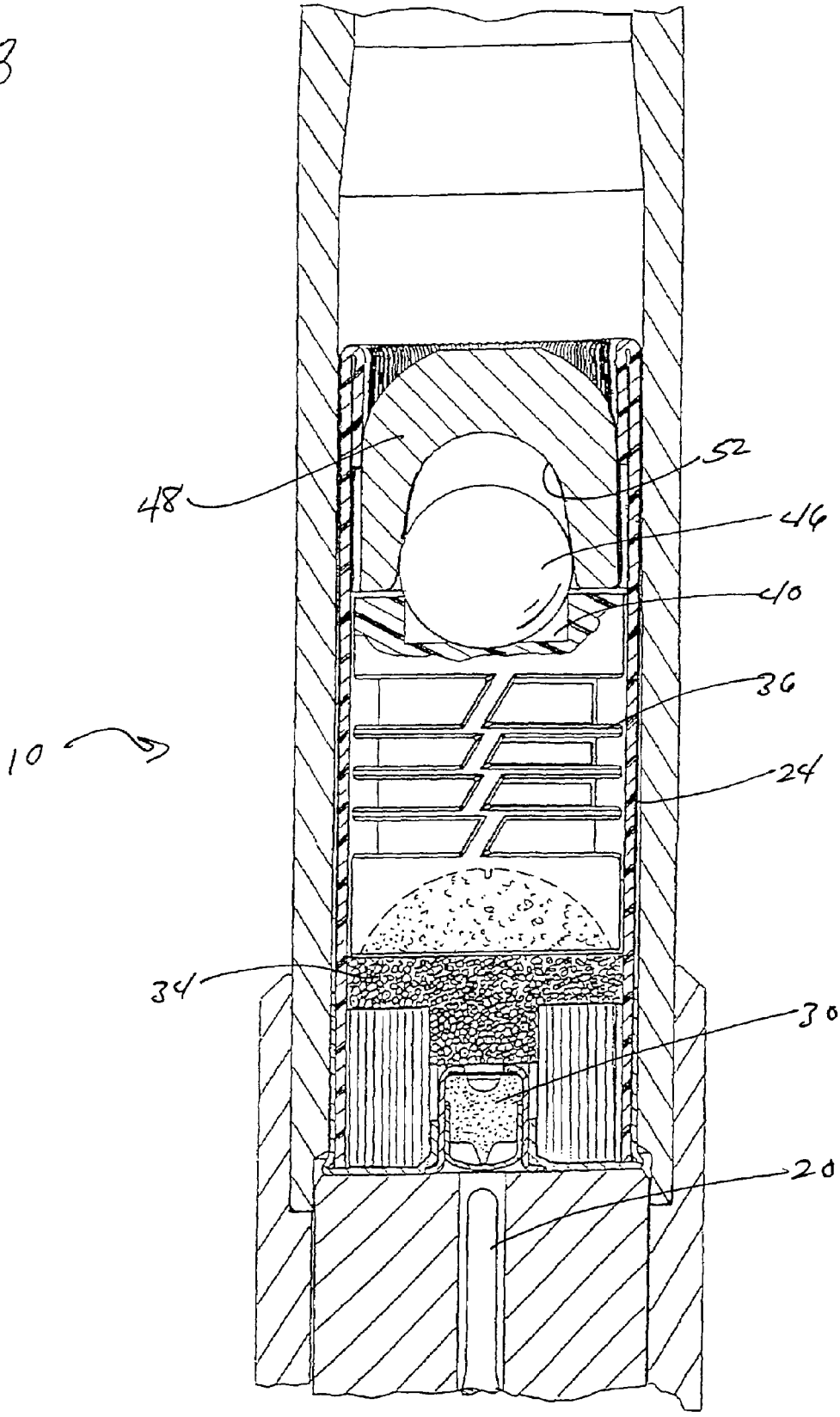
FIG. 3 is a view similar to FIG. 1 in which the slug is sub-bore diameter.

The shotgun shell 10 would typically include a brass shell base 26 having a rim 28 and an opening for the primer 30. The hull or cartridge 24 is the main tube that forms the remainder of the shell and carries the wads, powder propellant and slug. It is now typically formed of plastic but may be formed from a paper product. A base wad 32 is followed by propellant 34 which abuts against a wad 36. Wad 36 typically has a cupped base 38. The wad 36 is designed to include a depression 40 which is configured to mate with the inventive ball 46 of the invention. Ball 46 in FIG. 1 is shown abutted against a conventional full bore diameter "Foster" hollow based slug 48, fitted with appropriately sized ball 46 (½" to 9/16" range typically fits 12 ga. Foster slugs) and matched to the wad column 36 that is shown with a dimple or recessed spot 40 in the center of the top. The wad 36 of FIG. 3 is a plastic compression wad. The ball 46 is positioned against the hollow base 52 of slug 48.

Figure 2:
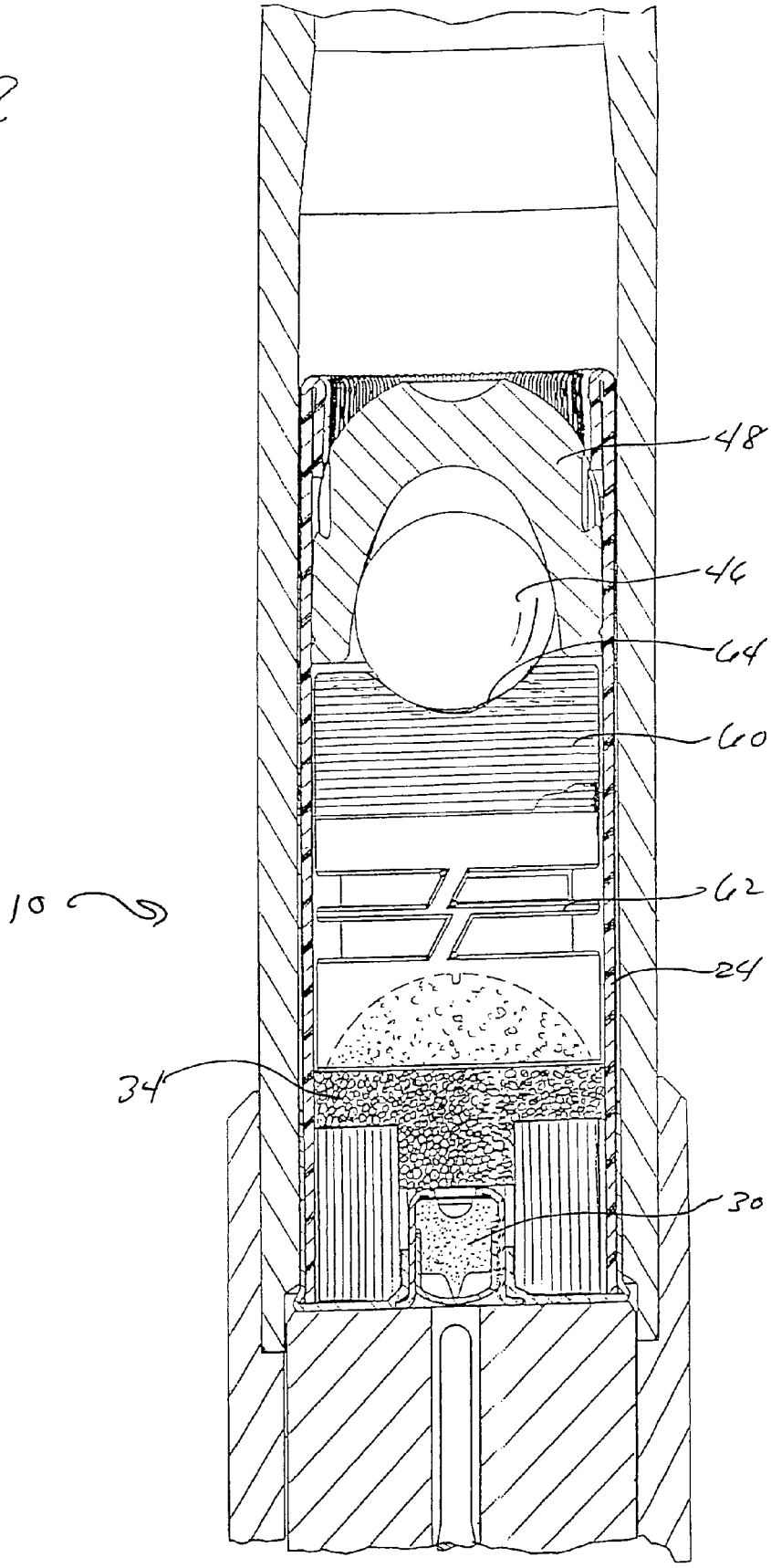
FIG. 2 is a view similar to FIG. 1 of the invention in which the wad is composed of two portions.

Fiber type wads can also be used the same way, by dimpling in the center to appropriate depth. FIG. 2 shows a fiber wad 60 in a shotgun shell 10 which is a secondary calendared paper or fiber wad in conjunction with a lower compressible plastic wad 62. The fiber wad 60 includes a central depression 64 to which the ball 46 is cupped.

Figure 4:
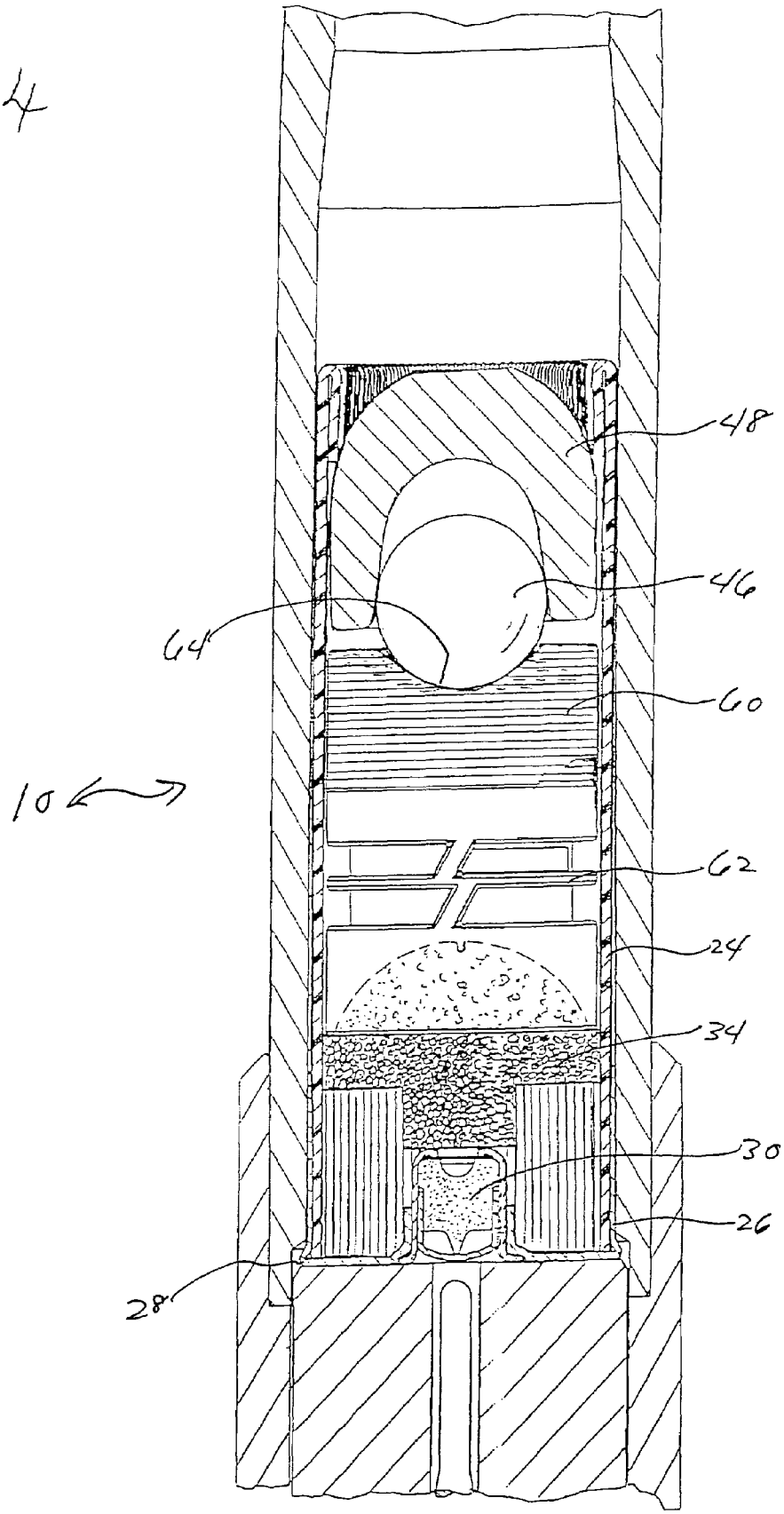
FIG. 4 is a view similar to FIG. 3 of the invention in which the wad is composed of two portions.

FIG. 3 shows a shotshell 10 of the invention in which the slug 48 is a sub-bore diameter rather than a full bore diameter slug of the Foster type. In all forms, the slug would have a recess in which the ball 46 may nest. The shotshell of FIG. 3 is intended to show that a slug 48 may be used which is under the bore size of the shotgun. FIG. 4 shows a modification to the shotshell of FIG. 3 in which the wad is formed with a fiber wad 60 having a depression 64 and a plastic wad 62 with a sub-bore diameter slug 48.

Hard, frangible non-toxic slugs 48, of sub-bore diameter, can be used in the same way, but being under bore diameter, are held in the center of a sufficiently stable wad column, thus the slug 48 is not allowed to touch the barrel metal.

The shotshell 10 of the invention is easy to load—properly dimensioned sphere 46 of suitable, inexpensive plastic, has no up or down side—can be used with conventional wads—often with little or no adjustment/alterations. The production of shells allows easy detection in the loading sequence of the ball 46 to make sure it is in place. The balls 46 are available commercially from several sources. Shapes and weight distributions of shotshell slug projectiles can be designed around this technology, allowing high performance not previously attainable from the simple, non-saboted slug.

Release of the projectile (slug) from the wadding is key—this technology ensures perfect alignment in the shell and on into the bore of the shotgun during firing—then, assures a clean release from the wadding upon exiting the barrel. Shorter shotgun barrels can achieve enhanced accuracy using this technology—this is opposite the normally expected performance of shotshell slugs!

Features of the Ball System Technology for Slugs and Other Projectiles for Smoothbores There are basically three parts: a hollow based slug or weight-forward projectile 48, a ball (sphere) and a wad (or built up wad column). How they interact to solve problems is unique.

1) Spheres

Balls can be made out of much lighter (less dense) material than the projectiles, are available commercially, and are inexpensive. All sizes needed are available in suitable materials. Polypropylene is a suitable choice as it is hard, lightweight and inexpensive.

2) Ease of Automatic Loading

For ease of automatic loading, the ball is superb. There is no top or bottom, and it is self-positioning in any depression. Its presence in the loading shell is easily detected during the loading process.

3) Works with any Kind of Wadding

The ball system can be used with one or multi-piece plastic wads, or in combination with card/fiber wads. All that is needed is a suitably sized cavity, or depression, in the center of the top of the top most side of the wad. This can be molded in, or mechanically created during loading. In the case of the basic Federal® W14 wad, there is a suitable cavity already in the wad, due to position of molding knock out punch.

4) Locating/Centering

If slug is of very hard material (tungsten or iron/steel, etc.) the ball will positively locate projectile in center of wad, and thus in center of cartridge and barrel, and thus can allow an extremely hard projectile, of sub-bore diameter, to be used without any 'sabot' or wad petal type barrel protecting devices. The roll crimp, bearing on the top of the projectile, contributes to perfect alignment in center of barrel.

5) Dimensional Control

If slug is of soft material (e.g. lead), then the ball can be used to locate, as in number 4 above, whether or not the projectile is full-bore diameter or sub-bore diameter, and can be used to cause expansion of the lead "skirt". If there is room (airspace) inside the slug between its inside nose and the ball, on firing the ball will try to fill this space, and if the interior walls are tapered, then the slug will be expanded essentially to the point that the ball cannot be pushed any farther into the cavity of the Foster slug. The amount and position of this expansion can be controlled by the dimensions of the slug, matched to the size of the ball. The bottom of full-bore diameter lead slugs can thereby be made to press tightly against the barrel of the gun, increasing accuracy.

6) Shapes and Weight Distribution Control

If there is no "airspace" in the inside of the slug, with the ball essentially the same shape and size as the inside of the slug, then the ball does not move in relation to the slug on firing, and this can be important in allowing thin skirts, so that we have control over the weight distribution of the slug, to aid in accuracy. A large ball can be used with thin skirt—the ball takes up the forces of firing, reducing or eliminating the disruption of the shape of the skirt of soft lead slugs. This was impossible in conventional foster slugs that just sat on a wad. Their skirts had to be much thicker and thus heavier, to maintain shape, withstanding the loads generated during firing. We can now control both shape and weight.

7) Separation of Components when Needed

Just as important as all the centering functions of the ball, is how it prevents wad parts from temporarily "attaching" themselves to the slug during the forces of firing. A clean separation, of slug and wad, is important. The ball creates the situation of providing to the wad, several times the original surface area of the slug to bear against, compared to a conventional foster slug, which means there is no little "rim" that just digs into wadding, creating a problem of not cleanly releasing from the slug at the moment acceleration forces cease. The ball always stays with the slug.

The tendency of soft lead slugs to "creep" (material flow under pressure) during firing, which allows the bottom of the slug to get irregularly temporarily attached to plastic wadding (by flowing over and around the edges of the wad), is essentially eliminated by the ball, which takes the brunt of firing forces.

8) Drag Reduction, Drag Control

That the ball always stays with the slug may also create a positive in that this may affect the drag coefficient of the projectile. There is no deep hollow cavity now in the slug going down range: instead, there is now a sort of "boat tail" shape of lightweight material projecting behind the slug proper.

9) Acceleration/Deceleration—Operation

This system uses the forces of acceleration to hold everything in proper positions during firing. Then, at the moment of deceleration, allows a clean break of contact, which provides the down range accuracy, with the heavier part (slug) going on ahead without any disruption by wadding.

Tests have shown that this system can provide much greater accuracy than other methods of slug loading when fired from very short barrels—10" to 18". This is due to the fact of acceleration all the way out of the short barrel. This is not the case in our experience with conventional loads.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A shotgun shell comprising:

(a) a shotshell base including a primer;

(b) a tubular hull extending from said shotshell base at a fore end and having an aft end which is closed until fired;

(c) propellant within said hull in contact with said primer;

(d) a wad within said hull, said wad having a fore end adjacent said propellant and an aft end, said aft end including a central depression;

(e) a slug within said hull adjacent the closed aft end, said slug including a fore end having a central depression; and (f) a single ball positioned between said wad and said slug to be cupped within said central depressions.

2. In a shotgun shell including a base with primer and a hull with a base wad holding propellant positioned against said primer, a compression wad and a slug, the improvement comprising disposing a single ball between said compression wad and said slug, said compression wad and slug each being constructed and arranged to include a central depression which contact said ball such that said ball is cupped therebetween.

3. The shotgun shell of claim 2 wherein said ball is non-metallic.

4. The shotgun shell of claim 2 wherein said ball is formed of plastic.

5. The shotgun shell of claim 2 wherein said slug has a diameter less than the bore for said shell.

6. A shotgun shell comprising:

(a) a shotshell base including a primer;

(b) a tubular hull extending from said shotshell base at a fore end and having an aft end which is closed until fired;

(c) propellant within said hull in contact with said primer;

(d) a wad within said hull, said wad having a fore end adjacent said propellant and an aft end, said aft end including a central depression;

(e) a slug within said hull adjacent the closed aft end, said slug including a fore end having a central depression; and (f) a single generally spherical member positioned between said wad and said slug within said central depressions.

* * * * *